US006735885B2

(12) United States Patent
Yaw

(10) Patent No.: US 6,735,885 B2
(45) Date of Patent: May 18, 2004

(54) DOUBLE-LAYER SANDAL

(75) Inventor: Larry Yaw, Taichung (TW)

(73) Assignee: Union Looper Co. Ltd., Taichung (TW)

( * ) Notice: Subject to any disclaimer, the term of this patent is extended or adjusted under 35 U.S.C. 154(b) by 40 days.

(21) Appl. No.: 10/246,618

(22) Filed: Sep. 19, 2002

(65) Prior Publication Data

US 2004/0055178 A1 Mar. 25, 2004

(51) Int. Cl.[7] ..... A43B 3/12
(52) U.S. Cl. ..... 36/11.5; 36/8.1
(58) Field of Search ..... 36/11.5, 3 R, 8.1, 36/43, 44, 141, 3 B

(56) References Cited

U.S. PATENT DOCUMENTS 2,284,947 A * 6/1942 Clifford ..... 36/44
4,419,836 A * 12/1983 Wong ..... 36/11.5
4,525,940 A * 7/1985 Mochizuki ..... 36/8.1
5,930,916 A * 8/1999 Connor ..... 36/11.5
6,003,246 A * 12/1999 Pan ..... 36/11.5
6,014,821 A * 1/2000 Yaw ..... 36/8.1
6,029,372 A * 2/2000 Pan ..... 36/11.5

* cited by examiner

*Primary Examiner*—M. D. Patterson
(74) *Attorney, Agent, or Firm*—Troxell Law Offices PLLC

(57) ABSTRACT

A double-layer sandal includes a sandal sole, a sandal top, a basic layer, a first netted layer and a second netted layer. The first netted layer is combined on the sandal sole, made of much plastic elastic thread interwoven together forming lots of solid and irregular rings, with numerous gaps formed among the elastic thread. The second netted layer combined on the first netted layer is made of a great deal of plastic elastic thread interwoven forming a great many solid and irregular rings, and having numerous gaps formed among the elastic rayon. The second netted layer has a smaller thickness, greater density and smaller gaps than the first netted layer. The first netted layer has great elasticity and good effect of ventilation and water penetration, and the second netted layer has a flat surface.

5 Claims, 4 Drawing Sheets

DOUBLE-LAYER SANDAL

BACKGROUND OF THE INVENTION

This invention relates to a double-layer sandal, particularly to one combined firmly and able to make a wearer feel comfortable.

A conventional sandal, disclosed in a Taiwan patent NO. 359972, titled "IMPROVED SANDAL" as shown in FIG. 1, includes a sandal sole 1, a sandal top 2 and a treading member 3. The treading member 3 is combined on the sandal sole 1 and is made of much elastic thread 4 interwoven together at loose intervals, having a great many gaps 5 among the elastic thread 4. The elastic thread 4 functions as a buffer of supporting and the gaps 5 make the easy ventilating and water penetrating well.

However, referring to FIG. 2, numerous comparatively large gaps 5 among the elastic thread 4 have to be formed for the purpose of facilitating ventilation and water penetration as well as making up elastic buffering spaces, and these gaps 5 are also formed on the surface of the treading member 3, letting a wearer feel uncomfortable. Besides, the material characters of the treading member 3 and the sandal sole 1 are not always the same and the producing process is restricted so they can hardly be firmly glued together before the elastic thread 4 is solidified and as a result, only the bottom side of the elastic thread 4 is adhered to the sandal sole 1, easy to give rise to separation of the treading member 3 from the sandal sole 1.

SUMMARY OF THE INVENTION

The objective of this invention is to offer a double-layer sandal having functions of ventilation and water penetration and able to make a wearer feel comfortable.

Another objective of the invention is to offer a double-layer sandal glued and combined very firmly.

The double-layer sandal in the present invention includes a sandal sole, a sandal top, a basic layer, a first netted layer and a second netted layer. The sandal top is connected with the sandal sole, having a wearing space between them for a foot to fit therein. The basic layer is a foam layer made of plastic and having the same profile as the sandal sole. The first netted layer with a definite thickness to be adhered to the topside of the sandal sole is made of much elastic plastic thread interwoven into a great many solid and irregular rings, with numerous gaps formed among the elastic thread. The second netted layer to be combined on the first netted layer is also made of much elastic plastic thread interwoven together forming lots of solid and irregular rings, having numerous gaps formed among the elastic thread. The second netted layer has a smaller thickness than the first netted layer, but the former has greater density and smaller gaps than the latter. Thus, the first netted layer has comparatively great elasticity and good effect of ventilation and water penetration, while the second netted layer has a relatively flat surface for a user to wear thereon with comfort.

BRIEF DESCRIPTION OF DRAWINGS

This invention will be better understood by referring to be accompanying drawings, wherein.

DETAILED DESCRIPTION OF THE PREFERRED EMBODIMENT

Figure 1:
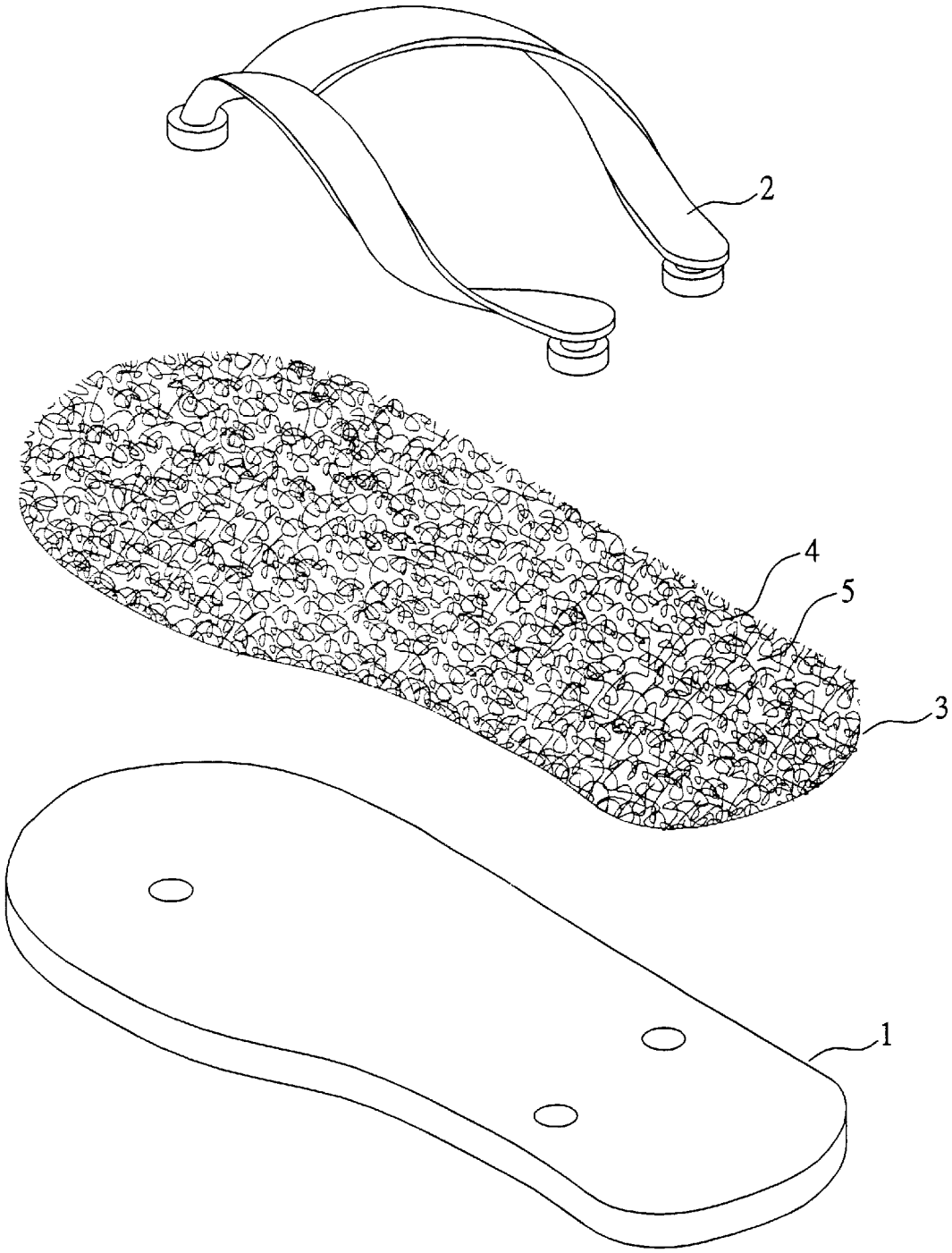
FIG.1 PRIOR ART
FIG. 1 is an exploded perspective view of a conventional sandal.
Figure 2:
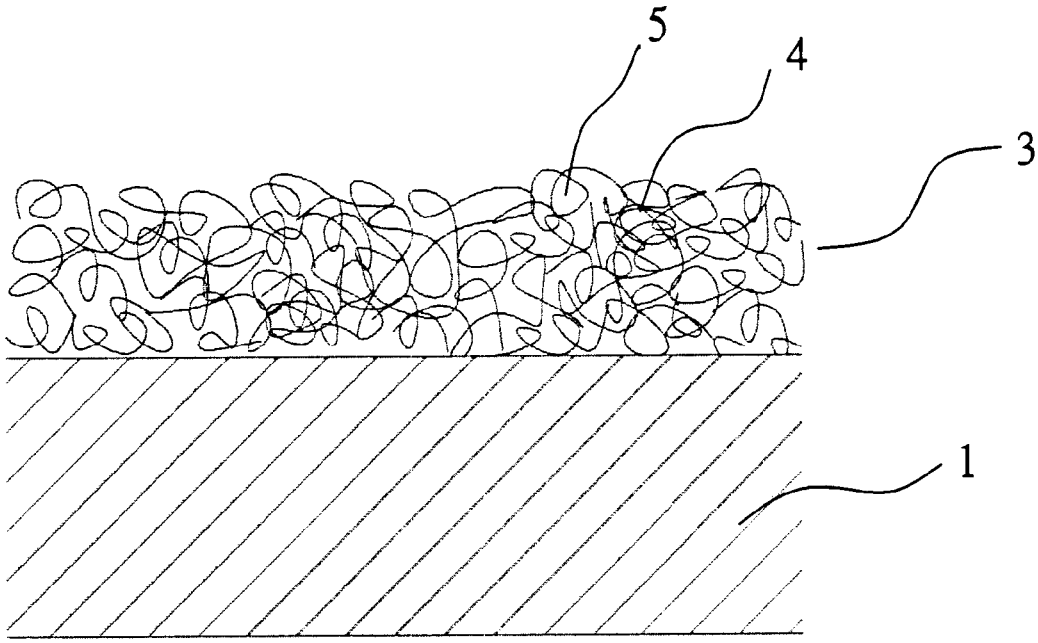
FIG. 2 PRIOR ART
FIG. 2 is a cross-sectional view of the conventional sandal.
Figure 3:
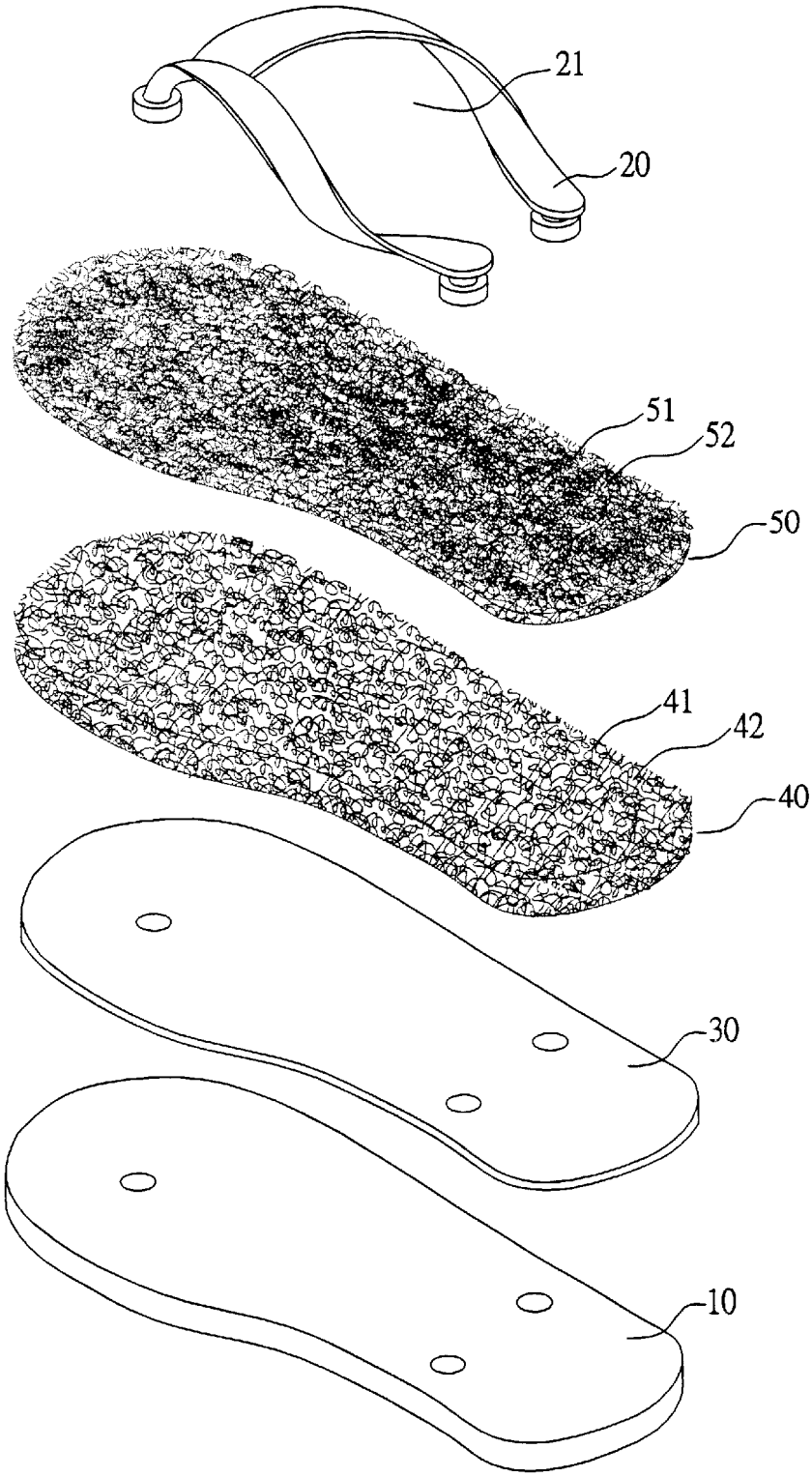
FIG. 3 is an exploded perspective view of a double-layer sandal in the present invention.
Figure 4:
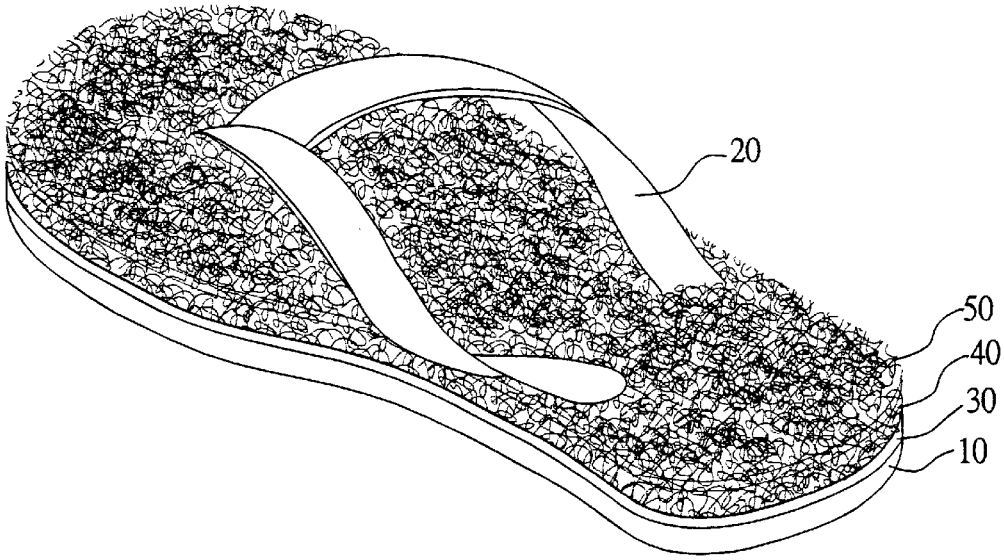
FIG. 4 is a perspective view of the double-layer sandal in the present invention.

A preferred embodiment of a double-layer sandal in the present invention, as shown in FIGS. 3 and 4, includes a sandal sole 10, a sandal top 20, a basic layer 30, a first netted layer 40 and a second netted layer 50 combined together.

The sandal sole 10 is of a definite profile.

The sandal top 20 is connected with the sandal sole 10, with a wearing space formed between them for a foot to fit therein.

The basic layer 30 is a foam layer made of high-molecule plastic, having the same profile as the sandal sole 10 and adhered closely to the top surface of the sandal sole 10.

The first netted layer 40 is combined on the basic layer 30, having the same profile as the basic layer 30 and a definite thickness. The first netted layer 40 is made of much elastic thread 41 of high-molecule plastic, which is interwoven together forming a great many solid and irregular rings and has numerous communicating gaps 42 therein. Further, both the first netted layer 40 and the basic layer 30 are made of plastic; therefore they can be adhered to each other by melting and firmly combined together after solidified.

The second netted layer 50 has the same profile as the first netted layer 40, combined on the first netted layer 40. The second netted layer 50 is made of a great deal of elastic thread 51 of high-molecule plastic interwoven together forming a great number of solid and irregular rings, with a lot of communicating gaps formed among the elastic thread 51. The second netted layer 50 has a smaller thickness, greater density and smaller gaps than the first netted layer 40, with the gaps 52 of the second netted layer 50 communicating with the gaps 42 of the first netted layer 40. As both the first and the second netted layer 40 and 50 are made of high-molecule plastic, they are easy to stick to each other by melting, and can be firmly combined together after solidified. In addition, the second netted layer 50 is fused and combined on the first netted layer 40 by proper compression so as to elevate the density of the elastic thread 51 on a unit area, and further the first and the second netted layer 40, 50 are of different colors to increase external beauty of the sandal and show exceptional feature of the invention.

Figure 5:
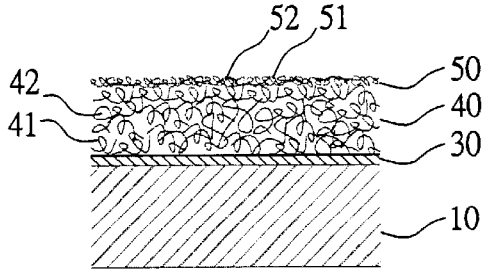
FIG. 5 is a cross-sectional view of the double-layer sandal in the present invention.

As described above, the second netted layer 50 is combined on the first netted layer 40 and has greater density and smaller gaps 52 than the first netted layer 40, with the gaps 52, 42 of the first and the second netted layer 50, 40 communicating with each other, as shown in FIG. 5. Thus, the first netted layer 40 with a comparatively large thickness and small density becomes soft and has functions of ventilation and water penetration, and the second netted layer 50 with a relatively small thickness and great density as well as small gaps 52 among the elastic thread 51 has a flat surface, not only letting a wearer have a good sense of touch and feel comfortable in wearing, but having effect of keeping a foot dry as well.

Furthermore, the basic layer 30 and the first netted layer 40 are made of the same material (high-molecule plastic), therefore the basic layer 30 provided between the first netted layer 40 and the shoe sole 10 functions as a transitional material to be glued together with the first netted layer 40 and the sandal sole 10, and the roughly-shaped material of the basic layer 30 is a feeding roll so it is convenient to be processed with the first netted layer 40 on a conveyer. Specifically, the first netted layer 40 can be fixedly combined together with the basic layer 30 by melted plastic liquid before the elastic thread 41 is solidified, while the sandal sole 10 and the basic layer 30 can be firmly adhered together by common glue. Evidently, the in-between basic layer 30 enables the sandal in this invention to be glued comparatively firmly.

While the preferred embodiment of the invention has been described above, it will be recognized and understood that various modifications may be made therein and the appended claims are intended to cover all such modifications that may fall within the spirit and scope of the invention.

I claim:

1. A double-layer sandal comprising:

A sandal sole:

A sandal top connected with said shoe sole, a wearing space formed between said sandal top and said sandal sole, said wearing space formed for a foot to fit therein:

A first netted layer combined on a top surface of said sandal sole, said first netted layer having a definite thickness, said first netted layer made of much plastic elastic thread, said plastic elastic thread interwoven together and forming a great many solid and irregular rings, lots of gaps formed among said elastic thread: and A second netted layer combined on said first netted layer, said second netted layer made of much plastic elastic thread, said elastic thread interwoven together and forming many solid and irregular rings, lots of gaps formed among said elastic rayon, said second netted layer having a smaller thickness than said first netted layer, said second netted layer having greater density than said first netted layer, said second netted layer having smaller gaps than said first netted layer:

Said first netted layer having great elasticity and effect of ventilation and water penetration, said second netted layer having a comparatively flat surface to make a wearer feel comfortable in wearing.

2. The double-layer sandal as claimed in claim 1, wherein said first and said second netted layer are firmly combined together by melting.

3. The double-layer sandal as claimed in claim 1, wherein a plastic basic layer is sandwiched between said sandal sole and said first netted layer, and said first netted layer and said basic layer are combined together by melted plastic liquid, while said sandal sole and said basic layer are adhered to each other by means of glue.

4. The double-layer sandal as claimed in claim 1, wherein said second netted layer is fused and combined on said first netted layer by proper compression so as to heighten the density of said elastic thread on per unit area.

5. The double-layer sandal as claimed in claim 1, wherein said first and said second netted layer are of different colors.

* * * * *